US006913491B2

(12) United States Patent
Tansi et al.

(10) Patent No.: US 6,913,491 B2
(45) Date of Patent: Jul. 5, 2005

(54) LAMP SOCKET

(75) Inventors: Hakki M. Tansi, Woodbury, NY (US); Eddie A. Ling, Great Neck, NY (US); Mehmet K. Tanacan, Farmingdale, NY (US); Jenkin P. Hua, Plainsboro, NJ (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 7 days.

(21) Appl. No.: 10/703,711

(22) Filed: Nov. 7, 2003

(65) Prior Publication Data

US 2005/0101187 A1 May 12, 2005

(51) Int. Cl.[7] ..... H01K 1/00

(52) U.S. Cl. ..... 439/615; 439/280; 439/587; 439/283

(58) Field of Search ..... 439/615, 587, 439/280–283

(56) References Cited

U.S. PATENT DOCUMENTS 773,725 A * 11/1904 Fielding ..... 439/615
3,775,634 A * 11/1973 Hasell et al. ..... 313/318.03
5,511,989 A * 4/1996 Cheng et al. ..... 439/419
5,874,800 A * 2/1999 Newman ..... 313/318.04
5,967,823 A * 10/1999 Tsui ..... 439/280

* cited by examiner

*Primary Examiner*—Truc Nguyen
(74) *Attorney, Agent, or Firm*—Paul J. Sutton

(57) ABSTRACT

There is disclosed a porcelain lamp socket for use in a humid environment where the socket has a body, a screw shell, a center contact and two terminals; one for the line and the other for the neutral wire connection. The screw shell and the line and neutral terminals are attached to the porcelain body by means of fasteners such as eyelets, rivets, screws, etc. All electrical conductors in the bottom of the socket, including the fasteners are covered with a spacer which forms a watertight seal with the bottom surface of the body. The spacer, which can be made of high dielectric plastic material, can be mechanically held in place by projections which fit snuggly within the eyelets or rivets. RTV, either by itself or in combination with soft fillers such as washers can also be used to obtain a water tight seal. The device disclosed finds utility in applications where superior dielectric strength is desired between the live parts on or in the socket and the sheet metal (ground) to which the socket is mounted.

12 Claims, 4 Drawing Sheets

LAMP SOCKET

BACKGROUND OF THE INVENTION

1. Field of the Invention

The present invention relates generally to lamp sockets and more particularly to a lamp socket in a housing which is adapted to be located in a wet/humid environment.

2. Description of the Prior Art

It is common to include some form of underwater lighting to enhance the night time effect of swimming pools, spas, fountains and the like. The usual method of providing the desired artificial light is to provide a watertight housing for an incandescent or halogen bulb. A common method of providing the light is to locate a housing in the floor of a fountain or in a vertical wall of a swimming pool. The lens of the housing is usually mounted to be flush with the floor of the fountain or the wall of the swimming pool. A gasket is provided to form a watertight seal between the lens and the housing body and the lens is designed to be separated from the housing body to permit the light bulb to be changed. The conventional underwater light is designed to use a flood type of incandescent bulb typically having a relatively high wattage.

A difficulty associated with a light bulb socket in a water tight housing is that the socket in the housing is normally exposed to a high humidity environment which contributes to corrosion of the electrical conducting paths. Thus, except for the electrical contacts between the bulb and the lamp socket, all other electrical contacts and conductive paths must be water tight. The sealing of the electrical contacts and conductive members of the socket is important to prevent shorting between the conductors, corrosion of the electrical contacts and the prevention of water forming a conductive path between the socket and the housing to insure that a person that comes in contact with the water around the housing will not receive an electrical shock.

Accordingly, there is a need for an improved socket which can be used in a high humidity environment.

SUMMARY OF THE INVENTION

There is disclosed a porcelain lamp socket for use in a wet/humid environment where the socket has a body, a screw shell, a center contact and two terminals; one for the phase conductor and the other for the neutral conductor located in a metal housing and which has, between the live parts on or in the socket and the metal housing ground to which the socket is mounted, superior dielectric strength. The screw shell and the phase and neutral terminals are coupled to the porcelain body with fasteners such as eyelets, rivets or screws. All electrical conductors in the bottom of the socket, including the eyelet rivets are covered with a spacer which forms a watertight seal. The spacer is mechanically held in place by projections which fit within the eyelet rivets. RTV or soft fillers can also be used to obtain a water tight seal.

The foregoing has outlined, rather broadly, the present invention so that those skilled in the art may better understand the detailed description of the invention that follows. Additional features of the invention will be described hereinafter that form the subject of the claims of the invention. Those skilled in the art should appreciate that they can readily use the disclose conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent form the following detailed description, the appended claim, and the accompanying drawings in which similar elements are given similar reference numerals, where:

DESCRIPTION OF A PREFERRED EMBODIMENT

Figure 1:
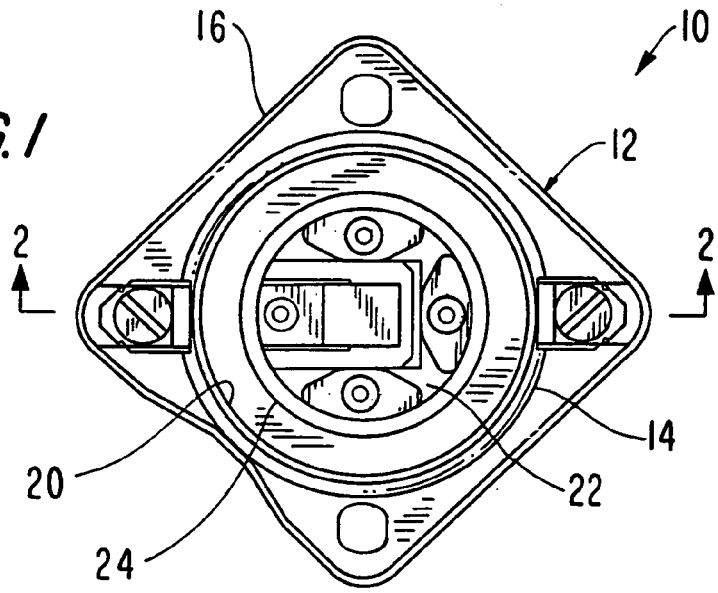
FIG. 1 is a top view of the socket in accordance with the principles of the invention.

Referring to FIG. 1, there is shown a top view of a lamp socket 10 in accordance with the principles of the invention. The lamp socket is adapted to receive an incandescent lamp or a high intensity halogen lamp having a medium screw base (not shown). The socket consists of a one piece non-conducting body 12 having an upper cylindrical shaped tubular member 14 and a substantially rectangular base member 16. The socket can be composed of porcelain or other non-conducting material such as a plastic which can withstand the increased temperatures generated by the lamp without deforming, melting or loosing its physical and electrical insulating properties.

The cylindrical tubular member 14 has an outer surface which extends downward to the top surface of the rectangular base and an inner surface 20 having a bottom surface or floor 22 which is below the top surface of the rectangular base. A screw shell 24, composed of conductive material such as copper, copper alloys, aluminum or other conductive metals, and threaded to receive the base of an incandescent or halogen lamp is located within the space defined by the inner surface 18 of the cylindrical tubular member 14.

Figure 3:
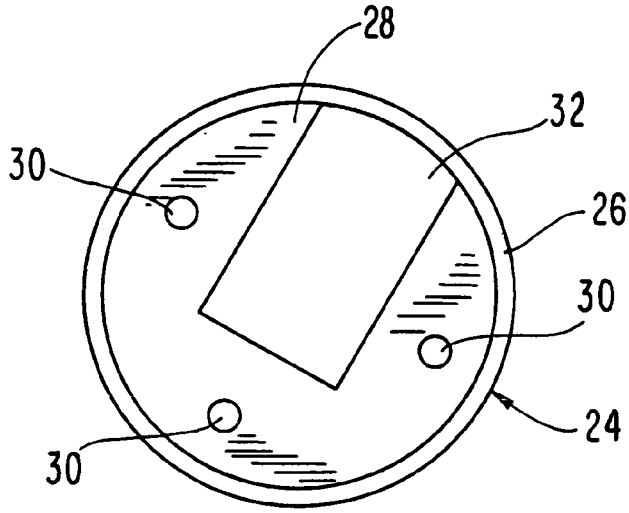
FIG. 3 is a top view of the screw shell.

Referring to FIG. 3, there is shown a top view looking into the screw shell 24. The screw shell 24 consists of a threaded upper section 26 designed to receive the screw base of a lamp and a base section 28. The threaded upper section and the base section can be formed from a single blank of a conductive metal such as copper or the like. The base section has three openings 30 sized to receive fasteners such as eyelets, screws or rivets, and a rectangular opening 32. The rectangular opening is sized and positioned to provide clearance for the center contact for the base of a lamp when located within the upper cylindrical member 14.

Figure 4:
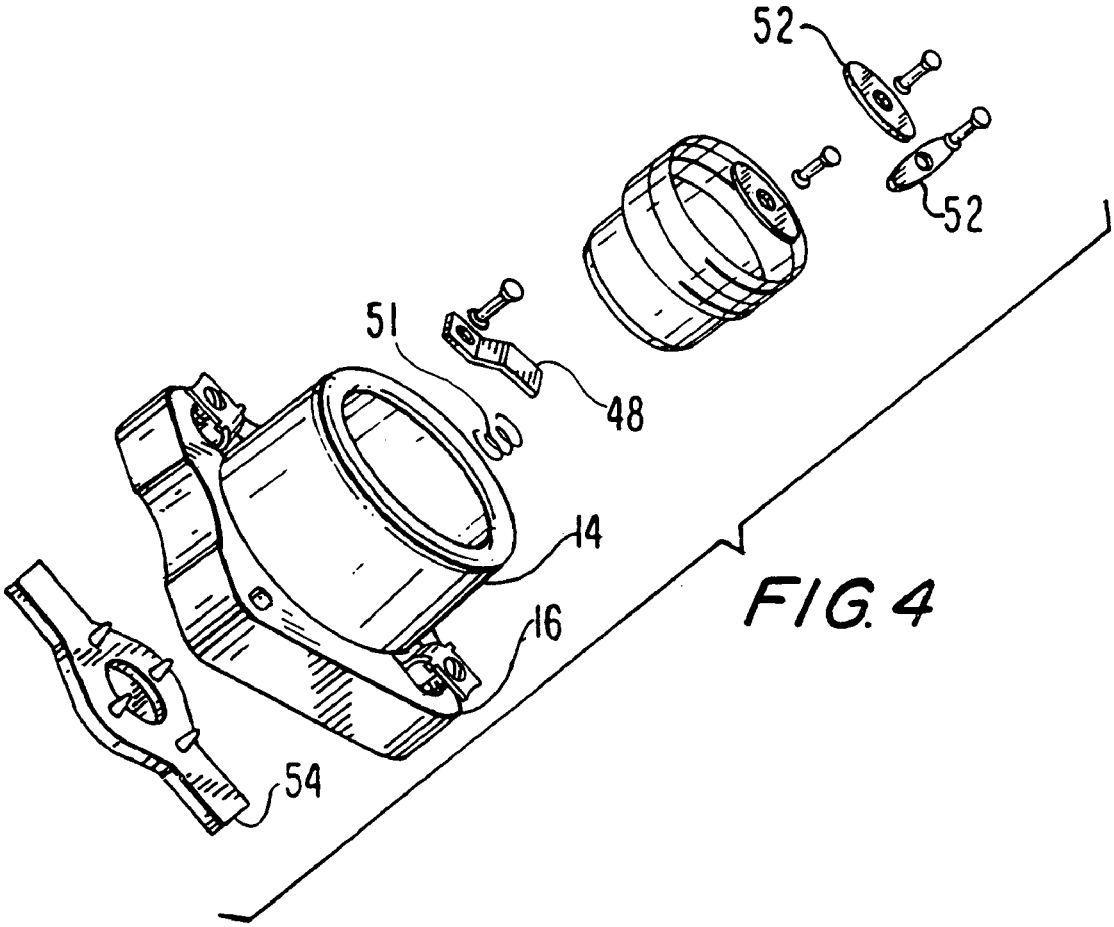
FIG. 4 is an isometric exploded view of the socket of FIG. 1.

Referring to FIG. 4, there is shown a isometric exploded view of the socket. The rectangular base member 16 has four openings which extend fully through the base from the top surface to the bottom surface. Two openings 34 in diagonal corners of the base member are sized to provide a sloppy fit for mounting member such as screws or bolts (not shown)

used to attach the socket to a light housing. Two contact terminal openings 36 in the other diagonal corners of the base member extend fully through the base member and are sized to accept the phase 38 and neutral 40 conductive strips (see FIG. 2) which supply current to the center contact and the screw shell.

Figure 6:
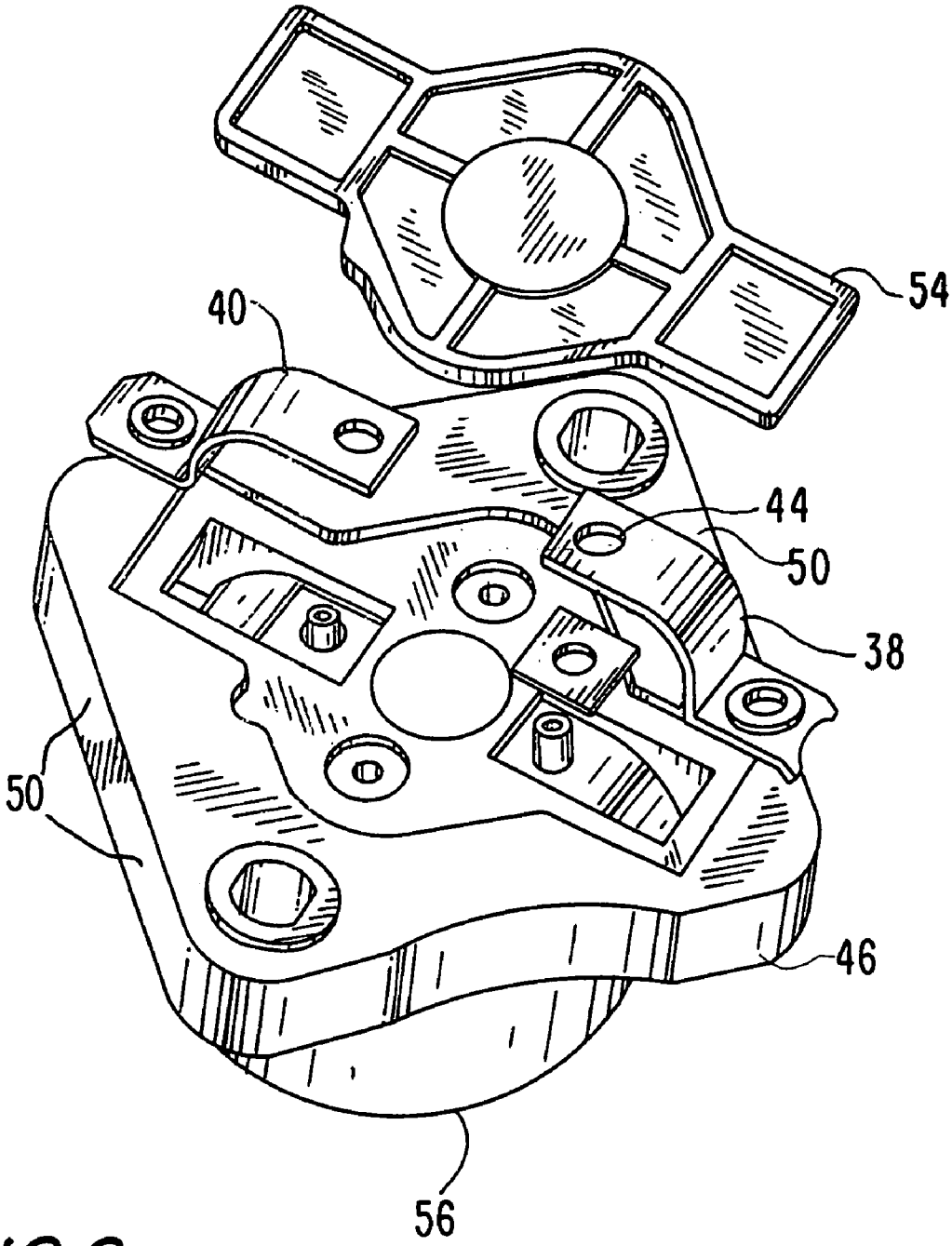
FIG. 6 is a partial isometric exploded view of the bottom of the socket of FIG. 1.
Figure 7:
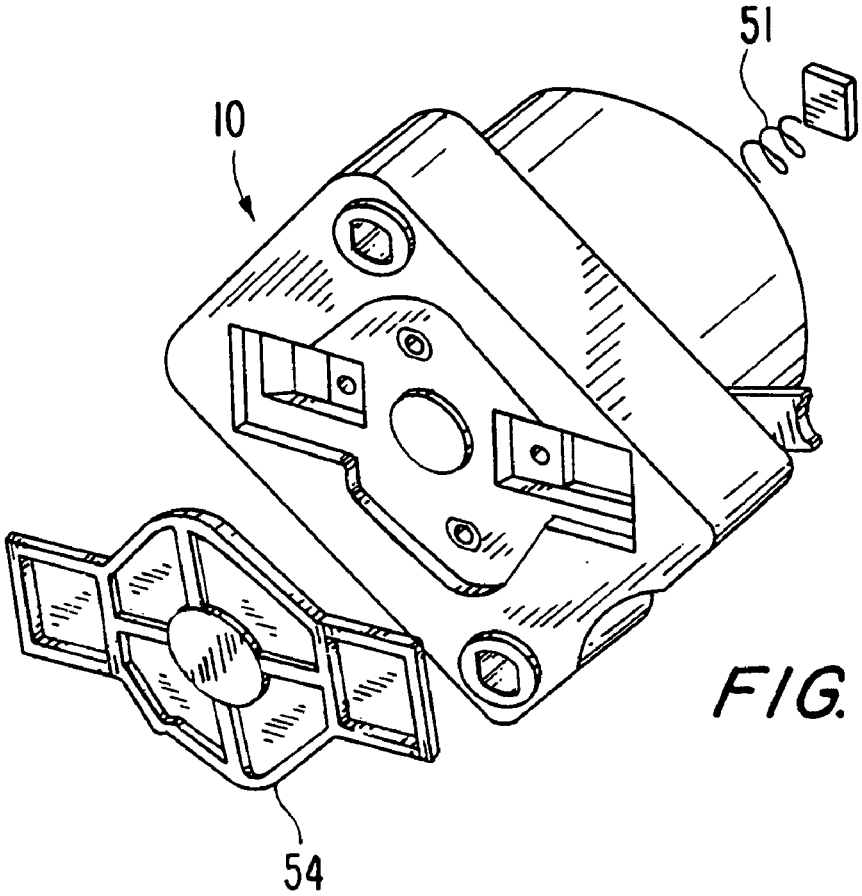
FIG. 7 is another partial isometric exploded view of the bottom of the socket of FIG. 1.

Referring to FIG. 6, there is shown an exploded view of the bottom of the socket. The phase and neutral conductive strips 38, 40 are identical and are interchangeable for manufacturing and assembly economies. Referring to the phase conductive strip 38, the wire connecting end supports a threaded opening for a screw (not shown) to which a conductor (not shown) is to be attached. The corners of the strip 38 at the threaded end are turned up to provide a channel there between for a wire conductor. Immediately beyond the threaded opening, the strip is bent at a right angle and then has a generous radius to permit the strip to be positioned through the top surface of the base member to a channel in the underside of the base member. The end of the strip located in the channel has an opening for receiving a fastener such as a screw, an eyelet or a rivet. For manufacturing reasons, the only difference between the strips 38, 40 is that one strip is provided with a silver colored terminal screw (for connection to the white circuit wire) and the other strip has a brass colored terminal screw (for connection to the black circuit wire).

Figure 2:
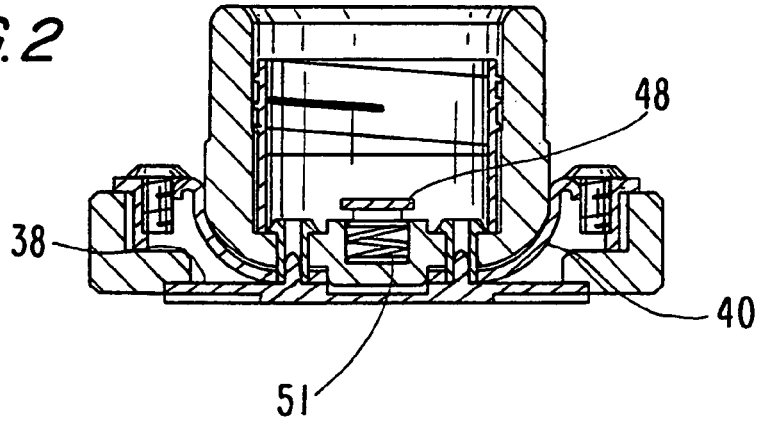
FIG. 2 is a sectional view along the line 2—2 of FIG. 1.

Referring to FIGS. 2 and 6, when the phase conductive strip 38 is positioned in the base member, the rivet receiving opening 44 is located to be in alignment with an opening 46 which extends through the base member The other end of opening 44 terminates in a channel in the bottom surface or floor 22. The center contact 48, see FIGS. 2 and 4, has a rivet receiving opening and an "S" bend and the center contact is designed to fit within the channel in the floor 22.

To assemble, phase and neutral conductive strips 38, 40 are inserted into their respective openings 36 with the ends having the eyelet, screw or rivet, receiving openings being located in their respective channels in the underside of the base member. The center contact 48 is placed in the channel in the floor 22 and an eyelet, screw or rivet is used to fasten the phase conductive strip 38 to the center contact 48. In some applications, a spring 51 can be placed under the center contact to assure that it maintains good contact with a bulb. A circular depression can be provided in the base member directly beneath the bulb contact section of the center contact to receive and keep the spring beneath the center contact.

Next, the screw shell 24 is placed within the upper cylindrical tubular member 14 and rotated to align the three openings 30 in the bottom of the screw shell with the three openings 50 that extend through the floor 22. The middle of the three openings 30 in the screw shell is aligned with the opening 42 in the neutral conductive strip 40 and they are electrically connected together with a rivet. At this time rivets are inserted into the remaining openings 30 to securely lock the screw shell to the porcelain socket. Prior to inserting the fasteners into the openings 30 of the screw shell, small support washers 52 are placed under the heads of the fasteners on the screw shell side to keep the screw shell from lifting up and being deformed if a user over tightens the bulb. The use of these washers is optional and, when used, seal around the fasteners that they surround. The washers can be of silicon or the like. At this time, the phase conductive strip 38 is located in the socket with the threaded end being located slightly above the top of the base member and being electrically connected to the center contact 48. In like manner, the neutral conductive strip 40 is located in the socket with the threaded end being located slightly above the top of the base member and is electrically connected to the screw shell 24.

Referring now to FIG. 6, to electrically isolate the conductive strips 38 and 40 along the bottom surface of the socket from the surface on which the porcelain socket is mounted, a plastic spacer 54 is attached to the bottom of the socket. As seen in FIG. 6, the bottom of the socket has a depression 56 which encompasses all of the openings in the bottom of the socket. Thus, the openings 30 for the eyelets, rivets or screws that hold the screw shell, the phase conductive strip and the neutral conductive strip; and the channels in which the phase and neutral conductive strips are locate all are located within the depression 56. Spacer 54 is shaped to fit snuggly within the depression 56 and the top surface of the spacer 54 is flush with the bottom surface of the socket. To further lock the spacer to the bottom of the socket, the spacer supports four projections 58, each of which is positioned to be aligned with an eyelet, rivet or screw and each of which has an outside dimension which fits snuggly within the centrally located openings of the eyelet rivets. After the socket is assembled, the spacer is connected to the bottom of the socket by forcing the projections 58 into the centrally located openings of the eyelet or rivet.

Figure 8:
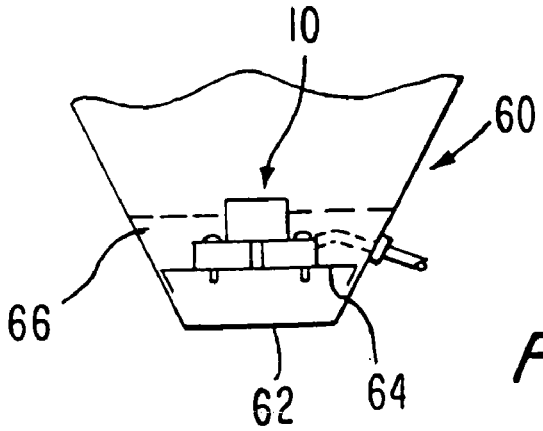
FIG. 8 is a partial cut away view of the socket located in a light housing and encased in a water tight non-conducting material.

One application of the socket here disclosed is with a housing that is located under water. Referring to FIG. 8, there is shown a partial sectional view of the socket located in a housing 60. As noted above, the top of the housing is attached to a lens in a water tight manner (not shown) and is removable to change the bulb.

The housing can be a truncated cone having a base 62. A support base 64 spot welded to the side of the housing is provided to hold the socket 10. The socket 10 is mounted, with sheet metal screws to the support base 64. An opening in the housing 60 located above the support base 64 and below to top of the socket 10 is provided for introducing an electrical conductor into the interior of the housing in a water tight manner. The three conductors, phase, neutral and ground of the electrical conductor are connected to the socket. Thereafter, a high dielectric water impervious filler such as RTV, an epoxy or the like is introduced into the housing to fill the space 66 from the support base up to the very top of the socket. At this time, all parts of the socket, but the opening for the bulb, are fully impervious to water.

Figure 5:
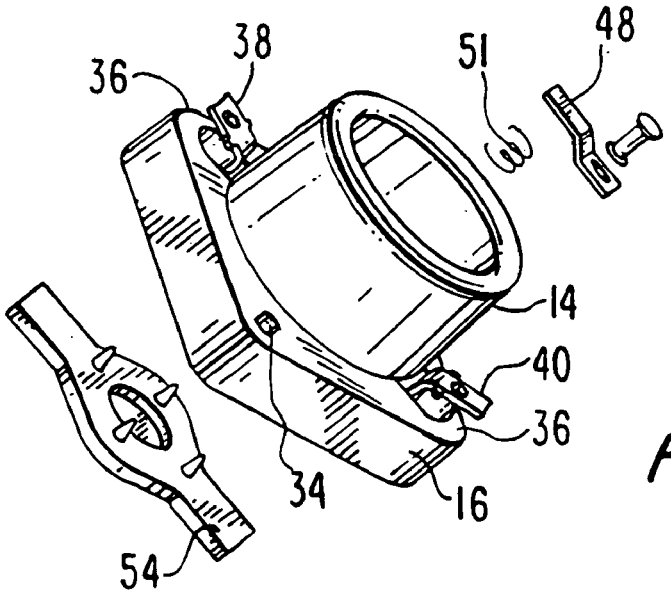
FIG. 5 is an isometric exploded view of another embodiment of the socket of FIG. 1.

In some embodiments, it may be more desirable to use an optional soft terminal pad on the phase and neutral strips. The pad does not replace the screw terminal, it just adds an optional layer of protection around the screw terminals. This embodiment is shown in FIG. 4. FIG. 5 shows the application of using quick connect terminals 38, 40 in place of the screw down connections. In some instances it may be more desirable to permanently connect the electrical wires to the terminals rather than using quick connect terminals or screw type terminals.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

What is claimed is:

1. A socket for a screw base lamp comprising:

a body of insulating material having a screw shell to receive and make electrical contact with the screw base of a bulb and a center contact to make contact with a base mounted center contact of the bulb; where the screw shell is coupled to the body of insulating material with fasteners such as eyelets, rivets, screws, etc. which terminate in a bottom of the body; and a spring located under the center contact of the socket to urge the center contact toward the center contact of the bulb;

wherein the body of insulating material comprises:

an upper cylindrical tubular member coupled to a rectangular base member wherein an upper surface of the rectangular base member forms a floor for the cylindrical tubular member;

an openings located in the floor which extend through to the bottom surface of the rectangular base member for receiving fasteners;

a channel located in the floor for receiving the center contact;

a depression centrally located in the floor for receiving a spring;

an openings located at opposite corners of the rectangular base member for receiving socket mounting fasteners;

an opening located at other opposite corners of the rectangular base member for receiving phase and neutral conductors;

a plurality of channels located in a bottom surface of the base member for receiving the phase and neutral conductors and locating them below the bottom surface of the rectangular base member; and a depression in the bottom surface of the base member for receiving a spacer.

2. The socket of claim 1 further comprising:

a nonconductive high dielectric spacer coupled to the bottom surface of the body.

3. The socket of claim 2 wherein the body of insulating material is porcelain.

4. The socket of claim 2 wherein the spacer covers all exposed electrical conducting parts on the bottom surface of the body and has projections for engaging openings in the body.

5. The socket of claim 4 wherein the spacer is flush with the bottom surface of the body.

6. The socket of claim 5 wherein the spacer forms a water tight seal with the bottom surface of the body.

7. The structure of claim 1 wherein the screw shell comprises;

a cup shaped member having a threaded upper section and a base section wherein the base section supports three openings for receiving fasteners and a rectangular opening for receiving, without contacting, the center contact.

8. The structure of claim 1 wherein the center contact comprises a flexible conductive strip having a clearance opening at a first end to receive a fastener, a flat section at the second end to engage the center contact of the bulb and an "S" bend located between the first and second ends to locate the first end below the second end.

9. The structure of claim 1 further comprising a first flat strip conductor for electrically connecting a wire conductor to the screw shell and a second flat strip conductor for electrically connecting another wire conductor to the center contact wherein the first and second flat strip conductors each have at a first end, a threaded opening for receiving a screw for connecting a wire conductor to the flat strip conductor; and at a second end, an opening for receiving a fastener, and a center section having a substantially right angle bend leading into a radius bend to allow the flat strip conductors to pass from the top to the bottom of the rectangular base member to contact the fasteners at the bottom of the rectangular base member which connect to the screw shell and the center contact.

10. The structure of claim 1 further comprising a first flat strip conductor for electrically connecting a wire conductor to the screw shell and a second flat strip conductor for electrically connecting another wire conductor to the center contact wherein the first and second flat strip conductors each have at a first end, a quick connect terminal for connecting a wire conductor to the flat strip conductor; and at a second end, an opening for receiving a fastener, and a center section having a substantially right angle bend leading into a radius bend to allow the flat strip conductors to pass from the top to the bottom of the rectangular base member to contact the fasteners at the bottom of the rectangular base member which connect to the screw shell and the center contact.

11. The socket of claim 1 further comprising high dielectric water impervious material surrounding the socket from the bottom surface of the rectangular base member to the top of the upper cylindrical tubular member.

12. The socket of claim 11 wherein the high dielectric water impervious material is RTV.

* * * * *

UNITED STATES PATENT AND TRADEMARK OFFICE

CERTIFICATE OF CORRECTION

PATENT NO. : 6,913,491 B2
DATED : July 5, 2005
INVENTOR(S) : Tansi et al.

It is certified that error appears in the above-identified patent and that said Letters Patent is hereby corrected as shown below:

Column 5,
Lines 12 and 19, “an openings” should read -- openings --.
Line 21, “an opening” should read -- openings --.

Signed and Sealed this

Fourth Day of April, 2006

JON W. DUDAS
*Director of the United States Patent and Trademark Office*